US009623680B2

(12) United States Patent
Sasaki et al.

(10) Patent No.: US 9,623,680 B2
(45) Date of Patent: Apr. 18, 2017

(54) LIQUID DISCHARGING APPARATUS

(71) Applicant: SEIKO EPSON CORPORATION, Tokyo (JP)

(72) Inventors: Tsuneyuki Sasaki, Matsumoto (JP); Shuichiro Nakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 20 days.

(21) Appl. No.: 14/789,287

(22) Filed: Jul. 1, 2015

(65) Prior Publication Data

US 2016/0001576 A1 Jan. 7, 2016

(30) Foreign Application Priority Data

Jul. 1, 2014 (JP) ..... 2014-135647

(51) Int. Cl.

*B41J 2/01* (2006.01)
*B41J 11/00* (2006.01)
*B41J 11/08* (2006.01)

(52) U.S. Cl.

CPC ..... *B41J 11/08* (2013.01); *B41J 2/01* (2013.01); *B41J 11/002* (2013.01)

(58) Field of Classification Search

CPC ..... B41J 2/01; B41J 11/002; B41J 11/08
See application file for complete search history.

(56) References Cited

U.S. PATENT DOCUMENTS 4,556,048 A * 12/1985 Maki ..... F24J 2/242 126/569
4,990,939 A * 2/1991 Sekiya ..... B41J 2/14129 347/100
5,074,971 A * 12/1991 Tsuya ..... G11B 5/84 205/162
2002/0097311 A1* 7/2002 Hinojosa ..... B41J 11/0025 347/104
2004/0201922 A1* 10/2004 Iida ..... G11B 5/127 360/230
2006/0170976 A1* 8/2006 Lo ..... B41J 2/1721 358/3.26
2007/0046722 A1* 3/2007 Komatsu ..... B41J 11/0065 347/30
2010/0119730 A1* 5/2010 Nelson ..... H05K 3/0011 427/543
2010/0136322 A1* 6/2010 Lite ..... B29C 44/24 428/317.9
2010/0225722 A1 9/2010 Elrod et al.
(Continued)

FOREIGN PATENT DOCUMENTS

JP 2005-096374 A 4/2005
JP 2005-324443 A 11/2005
JP 2010-208325 A 9/2010

*Primary Examiner* — Kristal Feggins
*Assistant Examiner* — Kendrick Liu
(74) *Attorney, Agent, or Firm* — Workman Nydegger

(57) ABSTRACT

Provided is a liquid discharging apparatus which includes a discharge portion which can discharge liquid, a medium support portion which has a support surface which can support a medium onto which the liquid is discharged, and a heating portion which can heat the medium supported by the medium support portion, in which at least a part of the medium support portion is constituted of a low thermal conductivity member having a thermal conductivity of 0.4 W/mK or less and the radiation rate of the support surface is set to a value equal to or greater than 0.7 and less than 1.

15 Claims, 6 Drawing Sheets

(56) References Cited

U.S. PATENT DOCUMENTS

| | | | | |
|---|---|---|---|---|
| 2012/0162335 | A1* | 6/2012 | Sasaki | B41J 11/06 347/102 |
| 2012/0224005 | A1* | 9/2012 | Koase | B41J 11/002 347/51 |
| 2012/0242744 | A1* | 9/2012 | Sutton | B41J 11/0065 347/31 |
| 2014/0028768 | A1* | 1/2014 | Chen | B41J 11/002 347/102 |
| 2014/0063164 | A1* | 3/2014 | Katagami | B41J 11/002 347/104 |
| 2014/0085365 | A1* | 3/2014 | Kasahara | B41J 2/04588 347/10 |

* cited by examiner

FIG. 6

| | MATERIAL | RADIATION RATE |
|---|---|---|
| MEDIUM A | ACRYLIC RESIN | 0.8 |
| MEDIUM B | ACRYLIC RESIN | 0.83 |
| MEDIUM C | PET RESIN | 0.85 |
| MEDIUM D | PET RESIN | 0.87 |
| MEDIUM E | VINYL CHLORIDE RESIN | 0.9 |
| MEDIUM F | VINYL CHLORIDE RESIN | 0.9 |
| MEDIUM G | VINYL CHLORIDE RESIN | 0.91 |
| MEDIUM H | CLOTH | 0.92 |
| MEDIUM I | PAPER | 0.94 |
| MEDIUM J | CLOTH | 0.95 |
| MEDIUM K | PAPER | 0.95 |

LIQUID DISCHARGING APPARATUS

BACKGROUND

1. Technical Field

The present invention relates to a liquid discharging apparatus which includes a medium support portion having a support surface supporting a medium onto which liquid is discharged and a heating portion which can heat, from a side opposite to the support surface, the liquid in the medium in a state where the medium is supported by the support surface.

2. Related Art

Hitherto, a liquid discharging apparatus which fixes an ink by heating a medium supported on a support surface of a medium support portion is known, as disclosed in JP-A-2010-208325.

In a printer disclosed in JP-A-2010-208325, it is described that a heat insulation platen having a low thermal conductivity is used.

However, in JP-A-2010-208325, there is no reference to a radiation rate of a part of the heat insulation platen, which is a portion supporting the medium. In other words, when, in the heat insulation platen, the radiation rate of the support surface in relation to the medium is not appropriately set, there is a problem in that the temperature of the support surface supporting the medium becomes unsuitable, and thus the image quality may be reduced.

SUMMARY

The invention can be realized in the following forms or application examples.

Application Example 1

According to this application example, there is provided a liquid discharging apparatus including a discharge portion which can discharge liquid, a medium support portion which has a support surface which can support a medium onto which the liquid is discharged, and a heating portion which can heat the medium supported by the medium support portion, in which at least a part of the medium support portion is constituted of a low thermal conductivity member having a thermal conductivity of 0.4 W/mK or less and the radiation rate of the support surface is set to a value equal to or greater than 0.7 and less than 1.

According to the configuration described above, at least a part of the medium support portion is constituted of the low thermal conductivity member, and thus heat conduction to other members is prevented. As a result, the thermal efficiency of the medium can be increased. Furthermore, the radiation rate of the support surface of the medium support portion is set to a value similar to that of the medium. Accordingly, the temperature of the support surface becomes an appropriate temperature close to a target temperature of the medium, and thus the image quality can be increased.

Application Example 2

In the liquid discharging apparatus according to the application example described above, it is preferable that the medium support portion includes a first member which is constituted by a material different from that of the low thermal conductivity member and forms the support surface and a second member which is the low thermal conductivity member.

According to the configuration described above, the temperature of the support surface can be appropriately maintained by the first member and the thermal efficiency of the support surface can be increased by the second member.

Application Example 3

In the liquid discharging apparatus according to the application example described above, it is preferable that the first member is constituted of aluminum subjected to alumite processing.

According to the configuration described above, the radiation rate of the first member can be increased and the radiation rate of the first member can be easily set to a value similar to that of the radiation rate of the medium. Accordingly, the temperature of the support surface can be appropriately held.

Application Example 4

In the liquid discharging apparatus according to the application example described above, it is preferable that a heat capacity of the first member is smaller than that of the second member.

According to the configuration described above, the heat capacity of the first member is relatively small, and thus it is easy to heat the first member. As a result, the temperature of the support surface can be appropriately held.

Application Example 5

In the liquid discharging apparatus according to the application example described above, it is preferable that the thickness of the first member is set to a value equal to or greater than 0.1 mm and equal to or lower than 1.0 mm.

According to the configuration described above, the thickness of the first member is relatively small, and thus the heat capacity of the first member is reduced. As a result, an amount of heat transferred from the medium to the first member is reduced, and thus the thermal efficiency can be increased.

Application Example 6

In the liquid discharging apparatus according to the application example described above, it is preferable that the thermal conductivity of the second member is lower than that of the first member.

According to the configuration described above, temperature reduction in the first member is prevented, and thus the temperature of the support surface can be appropriately held.

Application Example 7

In the liquid discharging apparatus according to the application example described above, it is preferable that the thickness of the second member is set to a value equal to or greater than 2 mm.

According to the configuration described above, the thermal insulation property can be stabilized.

Application Example 8

In the liquid discharging apparatus according to the application example described above, it is preferable that the second member is formed by laminating sheet-shaped materials including a thermosetting resin, a balloon, and a fiber-reinforced material.

According to the configuration described above, the thermal insulation property in which the value of the thermal conductivity is in the range of 0.4 W/mK or less and the strength of the second member can be easily ensured by the lamination structure of the sheet-shaped materials.

Application Example 9

In the liquid discharging apparatus according to the application example described above, it is preferable that, in the medium support portion, the low thermal conductivity member contains carbon and forms the support surface.

According to the configuration described above, the radiation rate of the support surface of the low thermal conductivity member is increased, and thus the temperature of the support surface can be appropriately held.

Application Example 10

It is preferable that the liquid discharging apparatus according to the application example described above further includes a downstream-side support portion which can support the medium in an area downstream from the medium support portion in a transport direction of the medium. In addition, it is preferable that a heat capacity of the downstream-side support portion is greater than that of the medium support portion.

According to the configuration described above, the heat of the heated medium is transferred to the downstream-side support portion, and thus a temperature increase of the medium is prevented. Accordingly, thermal damage to the medium by heat can be prevented.

Application Example 11

In the liquid discharging apparatus according to the application example described above, it is preferable that a dynamic friction coefficient of the support surface is set to a value equal to or less than 0.4.

According to the configuration described above, the transport resistance of the medium can be reduced, and thus damage during a transport process of the medium in a heated state can be reduced.

Application Example 12

In the liquid discharging apparatus according to the application example described above, it is preferable that, in the support surface, a suction hole is provided to allow a suction force to act on the medium.

According to the configuration described above, the medium can be easily held in a sucked manner, and thus liquid can be discharged in a state where the medium is stabilized.

Application Example 13

In the liquid discharging apparatus according to the application example described above, it is preferable that the heating portion heats the liquid discharged onto the medium so that the temperature of the liquid is with in a range from 35° C. to 60° C.

According to the configuration described above, the liquid discharged onto the medium can be sufficiently dried.

Application Example 14

In the liquid discharging apparatus according to the application example described above, it is preferable that the heating portion heats the liquid discharged onto the medium so that a temperature of the liquid becomes equal to or lower than a heat resistance temperature of the discharge portion.

According to the configuration described above, the liquid can be heated without causing failure of the discharge portion.

Application Example 15

In the liquid discharging apparatus according to the application example described above, it is preferable that the heating portion heats the liquid discharged onto the medium by emitting an electromagnetic wave having a wavelength of, at least, 2.0 μm to 6.0 μm.

According to the configuration, the liquid can be effectively heated.

Application Example 16

It is preferable that the liquid discharging apparatus according to the application example described above further includes a blower which blows wind towards the liquid discharged onto the medium.

According to the configuration, the liquid discharged onto the medium can be effectively dried.

BRIEF DESCRIPTION OF THE DRAWINGS

The invention will be described with reference to the accompanying drawings, wherein like numbers reference like elements.

FIG. 6 is an explanatory view illustrating radiation rates of various media.

DESCRIPTION OF EXEMPLARY EMBODIMENTS

Hereinafter, details of liquid discharging apparatuses according to Embodiments 1 and 2 of the invention will be described with reference to the accompanying drawings.

Embodiment 1

See FIGS. 1 to 6

First, (1) the schematic configuration of a liquid discharging apparatus according to Embodiment 1 is described. Next, (2) the configuration and an operation of a medium support portion as the principal portion of the invention is described in detail.

Figure 1:
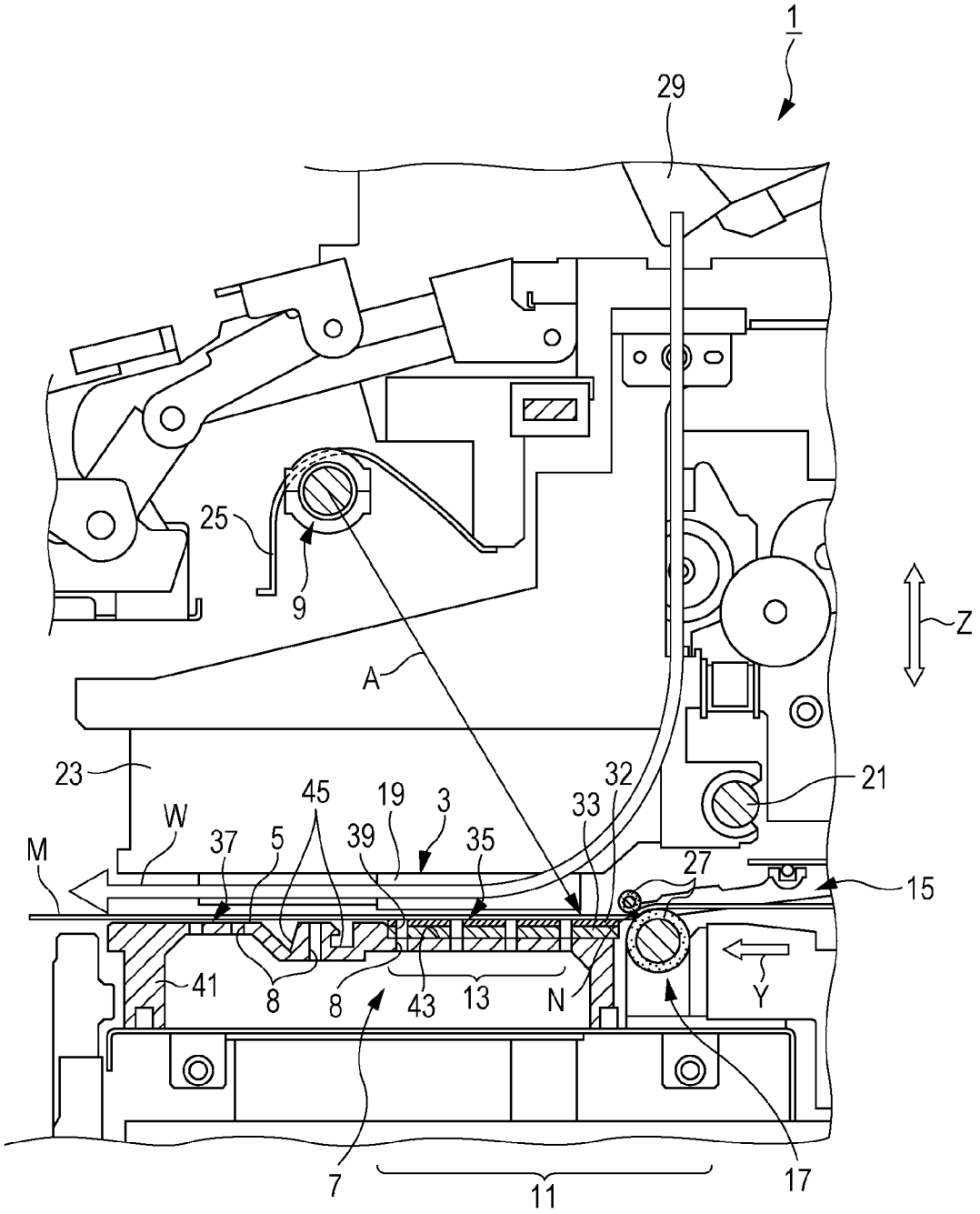
FIG. 1 is a lateral cross-sectional view illustrating a liquid discharging apparatus according to Embodiment 1.
Figure 2:
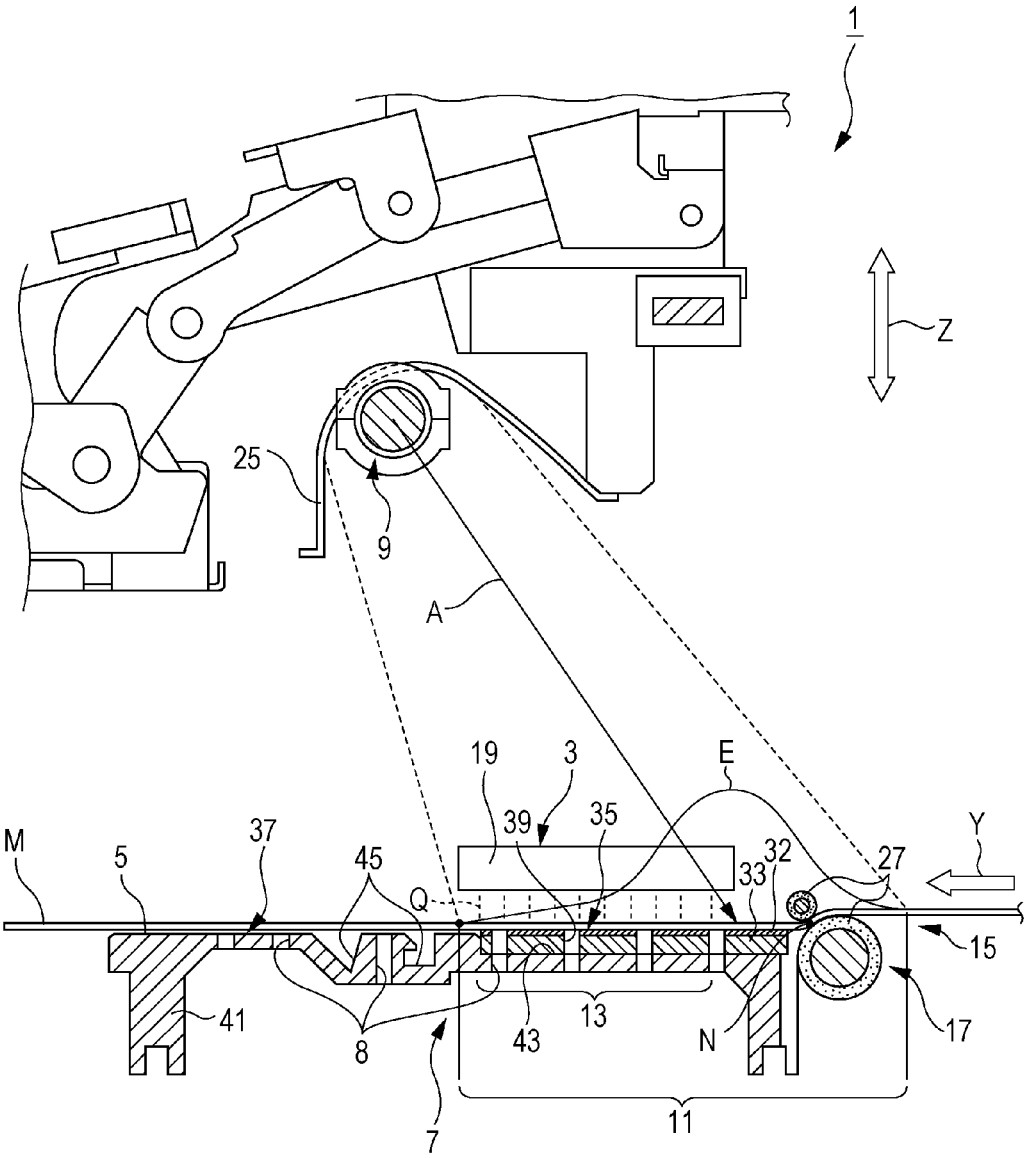
FIG. 2 is an enlarged lateral cross-sectional view of a principal portion of the liquid discharging apparatus according to Embodiment 1.

(1) Schematic Configuration of Liquid Discharging Apparatus (See FIGS. 1 and 2)

A liquid discharging apparatus 1 according to an embodiment of the invention is basically configured to include a medium support portion 7 and a heating portion 9. The medium support portion 7 has a support surface 5 which supports a medium M onto which a liquid Q is discharged. The heating portion 9 can heat the medium M from a side opposite to the support surface 5 side of the medium M in a state where the medium M is supported by the support surface 5. In other words, the liquid discharging apparatus 1 includes the heating portion 9 which can heat the liquid Q discharged onto the medium M.

In this case, an example of the heating portion 9 includes a device which performs heating by irradiating a target with an electromagnetic wave A, such as an infrared light beam. However, the example of the heating portion 9 is not limited thereto. That is, any device can be used as the heating portion 9 as long as it can heat the medium M in a state where the medium M is supported by the support surface 5, from a side opposite to the support surface 5.

The liquid discharging apparatus 1 of the embodiment is an ink jet printer having a configuration in which, for example, the heating portion 9 emitting an electromagnetic wave A, such as an infrared light beam, is used and a transport portion 17 which transports the medium M from an upstream side to a downstream side in a transport direction Y is provided.

Accordingly, in the embodiment, the liquid Q is ink. The liquid Q has properties in which a liquid component in the ink is thermally heated by radiation heat of the electromagnetic wave A, and thus colorant (such as, pigment and a dye) in the ink is fixed to the surface of the medium M.

In addition, the liquid discharging apparatus 1 includes a discharge portion 3 which can discharge the liquid Q. The discharge portion 3 includes a discharge head 19 and a carriage 23. The discharge head 19 discharges the liquid Q. The carriage 23 reciprocates in a width direction X as a scanning direction, which is a direction perpendicular to the transport direction Y of the medium M, along a carriage guide shaft 21, in a state where the discharge head 19 is mounted on, for example, the lower surface of the carriage 23.

In addition, paper, a vinyl chloride resin, cloth (a woven fabric using, for example, cotton, hemp, or silk), an acrylic resin, a polyethylene terephthalate (PET) resin, or the like can be used as a material of the medium M.

In this case, materials of various thicknesses can be used. In addition, a disc, such as, a CD and a DVD, may be used as the medium M.

The medium support portion 7 is a support member of the medium M which is provided at a position opposite to a discharge surface of the discharge head 19. The medium support portion 7 has a function for defining a gap between the support surface 5 of the medium support portion 7 and the discharge surface of the discharge head 19.

The medium support portion 7 is a unique configuration member of the invention, as described below.

The electromagnetic wave A is directly radiated from the heating portion 9 to the medium M on the support surface 5, as described above, or the electromagnetic wave A is indirectly radiated to the medium M on the support surface 5 via a reflector 25 which is a reflective plate. For example, an infrared light beam, a far-infrared light beam, or a visible light beam which causes radiation heat to be generated in a radiation target are used as the electromagnetic wave A. In the embodiment, an infrared light beam is used as an example of the electromagnetic wave A. An infrared heater is applied as the heating portion 9.

The transport portion 17 includes a medium transport path 15, a guide member (not illustrated), a suction member (not illustrated), and a member for transporting the medium M. The medium transport path 15 is formed in the liquid discharging apparatus 1. The guide member, such as a guide roller, guides transport of the medium M in the medium transport path 15. The suction member holds, in a sucking manner, the medium M through a plurality of suction holes 8 formed in the support surface 5 of the medium support portion 7. The member for transporting the medium M includes a pair of nip rollers 27 which feed the medium M into the gap between the discharge head 19 and the medium support portion 7.

In the embodiment, in an irradiated area (in other words, a heated area) 11 of the medium M on the support surface 5, onto which the electromagnetic wave A is radiated, a drying fan as a blower 29 which sends wind W from an upstream side to a downstream side in the transport direction Y of the medium M by the transport portion 17 is provided at an upper position in a vertical direction Z of the irradiated area (in other words, the heated area) 11, as illustrated in FIG. 1.

A plurality of blowers 29 are provided in the width direction X. The blowers 29 can send the wind W, in a straight line shape, along the width direction X. In an area in which the outer the carriage 23 is located, the wind W is blocked by the carriage 23. Thus, in relation to a space area in the width direction X, other than the area in which the carriage 23 is located, the blower 29 has a function for promoting drying of the liquid Q discharged onto the medium M by causing the wind W to flow as illustrated by the arrow in FIG. 1.

(2) Configuration and Operation of Medium Support Portion (See FIGS. 1 to 5)

In the liquid discharging apparatus 1 according to the embodiment, at least a part of the medium support portion 7 is constituted of a low thermal conductivity member of which the thermal conductivity is set to a value equal to or less than 0.4 W/mK. The radiation rate of the support surface 5 is set to a value equal to or greater than 0.7 and less than 1. In many cases, a medium of which the radiation rate is set to a value equal to or greater than about 0.8 and less than approximately 1 is used as the medium M. The details of this will be described below. Accordingly, the radiation rate of the support surface 5 is set to a value similar to that of the medium. The medium support portion 7 of the embodiment includes a first member 32 and a second member 33. In this case, the first member 32 is constituted of a material different from that of the low thermal conductivity member. The first member 32 is a member constituting the support surface 5. The second member 33 is a low thermal conductivity member of which the thermal conductivity is set to a value equal to or less than 0.4 W/mK.

Figure 3:
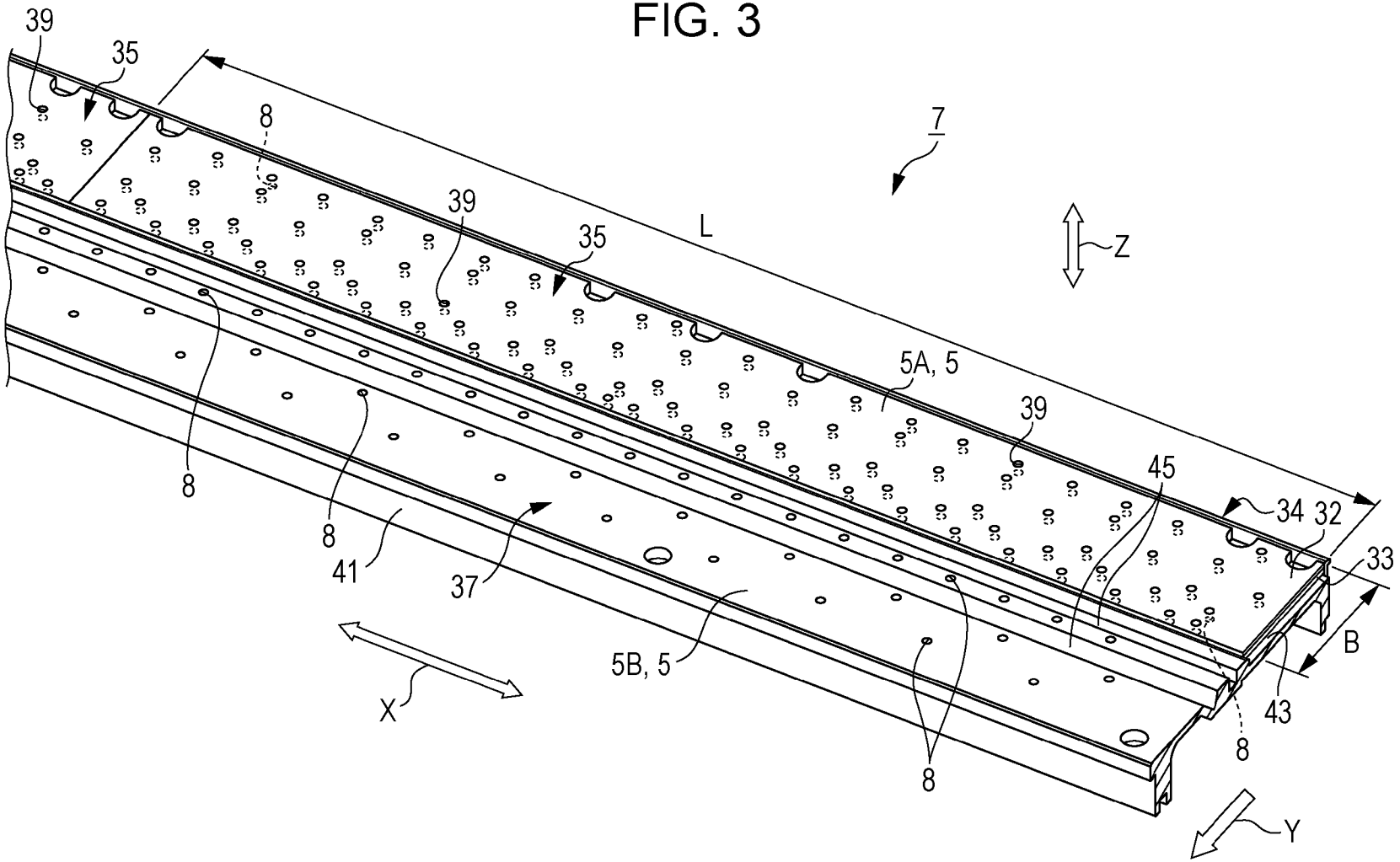
FIG. 3 is a perspective view illustrating a medium support portion of the liquid discharging apparatus according to Embodiment 1.
Figure 4:
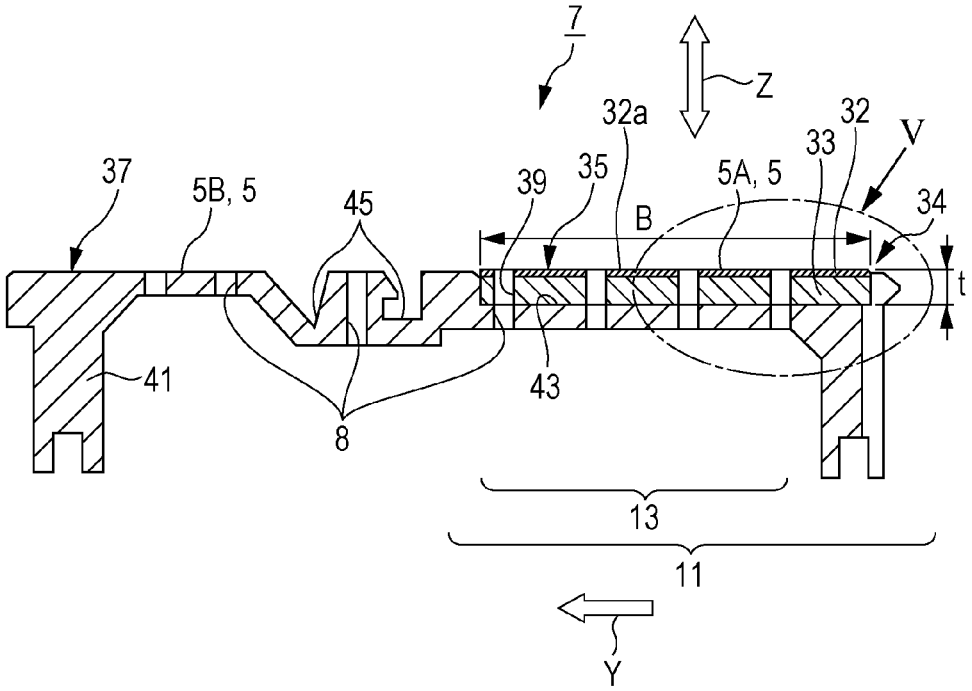
FIG. 4 is a lateral cross-sectional view illustrating the medium support portion of the liquid discharging apparatus according to Embodiment 1.

In the embodiment, a main body portion 41 of the medium support portion 7 has a uniform cross-sectional shape, as illustrated in FIG. 4. The main body portion 41 extends in the width direction X, as illustrated in FIG. 3, and is constituted of a frame member made of, for example, an aluminum.

Figure 8:
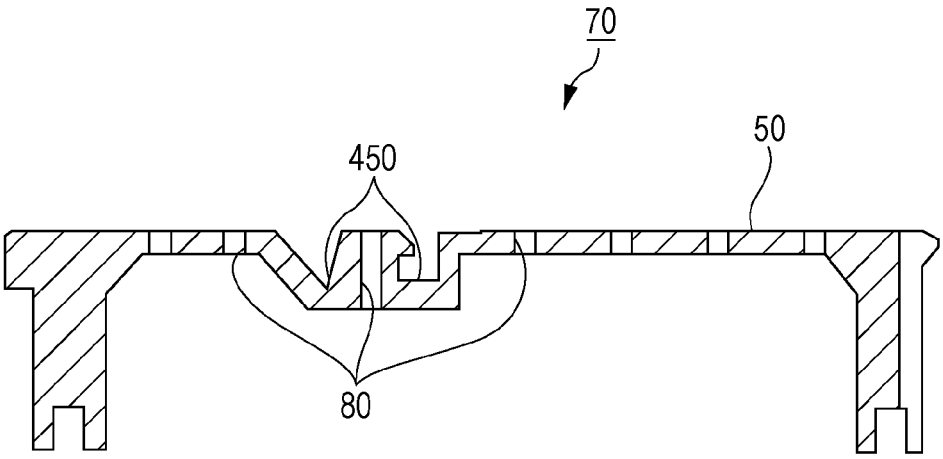
FIG. 8 is a lateral cross-sectional view illustrating a medium support portion of a liquid discharging apparatus of the related art.

A medium support portion 70 of the related art is illustrated in FIG. 8. The medium support portion 70 of the related art includes a support surface 50, suction holes 80, and a sensing groove portion 450. However, the first member 32 and the second member 33 described above are not provided in the medium support portion 70.

In the embodiment, a concave portion 43 which accommodates a first configuration portion 35 constituted of the first member 32 and the second member 33 is formed in the main body portion 41 of the medium support portion 7. The first configuration portion 35 is attached to the concave portion 43. Specifically, the second member 33 is attached to a bottom surface of the concave portion 43 and the first member 32 is formed above the second member 33, as illustrated in FIG. 4. In the embodiment, the first member 32 is formed over the entirety of the surface of the top portion of the second member 33.

In addition, in an area downstream from the concave portion 43 in the transport direction Y, sensing groove portions 45 which accommodate sensors (not illustrated) used for sensing, for example, the position of the medium M are aligned in the width direction X. The number of sensing groove portions 45 is, for example, two.

Thermal energy which is applied from the heating portion 9 to the medium M, in order to dry the liquid Q, is transferred to the support surface 5 for supporting the medium M. Next, the temperature of the support surface 5 is transferred to the first member 32 having the support surface 5. The radiation rate of the support surface 5 is set to a value similar to that of the medium M. Accordingly, when the medium M is supported by the support surface 5, the temperature of the support surface 5 becomes the temperature close to a target temperature of the medium M. The target temperature is a temperature which is the target intended to be reached by the heat of the heating portion 9. Accordingly, the temperature of the support surface 5 becomes an approximate temperature, and thus the image quality can be increased. Furthermore, the supported surface of the medium M can be appropriately heated by appropriately maintaining the temperature of the support surface 5.

When it is assumed that the temperature of the support surface 5 is greatly different from the target temperature, a large temperature difference occurs between the front side (which is the side onto which the liquid Q is discharged) and the rear side (which is the side in contact with the support surface 5) of the medium M. The reason for this is that the temperature of the front side of the medium M becomes a temperature close to the target temperature and, in contrast, the temperature of the rear side of the medium M does not become a temperature close to the target temperature due to an influence of the support surface 5. Accordingly, when the radiation rate of the support surface 5 of the medium support portion 7 is set to a value equal to or greater than 0.7 and less than 1, the temperature of the support surface 5 becomes an appropriate temperature, and thus the image quality can be increased.

Furthermore, the second member 33 of which the thermal conductivity is relatively low is provided below the first member 32, and thus it is difficult for the thermal energy of the first member 32 to be transferred to the second member 33. Accordingly, outflow of the thermal energy from the first member 32 is suppressed, and thus the heat retaining property of the first member 32 can be increased. In addition, the second member 33 is provided in a portion between the first member 32 and the main body portion 41, and thus it is difficult for the thermal energy to be transferred to the main body portion 41. In other words, it is difficult for the thermal energy to be transferred to the main body portion 41. The mass of the main body portion 41 is relatively large, and thus energy efficiency is increased by suppressing outflow of the thermal energy to the main body portion 41.

Therefore, the energy efficiency at the time of heating the medium M increases, and thus it is sufficient even when the thermal energy output from the heating portion 9 is reduced (power saving). As a result, the entirety of the liquid Q discharged onto the medium M can be evenly heated and it is possible to effectively perform heating with reduced thermal energy. In addition, the damage to the medium M during heating can be reduced.

Next, the area where the first configuration portion 35 is provided in the medium support portion 7 will be described.

Discharge Area

In the embodiment, the first configuration portion 35 is configured so that the first configuration portion 35 is provided in at least a part of a portion of the support surface 5, which is the portion supporting a discharge area 13 of the medium M, onto which the liquid Q is discharged. The meaning of "provided in at least a part of" is that the first configuration portion 35 may be provided over the entirety of the discharge area 13 or may be provided in at least a part of the discharge area 13. In the embodiment illustrated in the accompanying drawing, the first configuration portion 35 is provided in almost the entirety of the discharge area 13 and, further, is provided in a portion on a side upstream from the discharge area 13 in the transport direction Y.

The discharge area 13 is an area in which the liquid Q is discharged onto the medium M. Thus, to perform drying, a large amount of thermal energy is applied from the heating portion 9 to the discharge area 13. In the embodiment, the first configuration portion 35 is provided in a portion to which a large amount of the thermal energy described above is applied. Thus, thermal unevenness in relation to the liquid Q can be suppressed in the discharge area and the amount of heat of the thermal energy transferred to the medium support portion 7 can be effectively reduced. Accordingly, the liquid Q discharged onto the medium M can be evenly dried and it is possible to effectively perform heating with further reduced energy.

The structure is particularly effective in the liquid discharging apparatus 1 having a structure in which the liquid Q is heated immediately after the liquid Q is discharged onto the medium M.

Heated Area

The first configuration portion 35 may be configured with a view that the first configuration portion 35 is provided in at least a part of a portion of the support surface 5, which is the portion supporting a heated area 11 of the medium M, which is heated by the heating portion 9.

The meaning of "provided in at least a part of" is that the first configuration portion 35 may be provided over the entirety of the heated area 11 or may be provided in a part of the heated area 11, similar to the above description.

In FIG. 2, a reference letter E indicates the distribution of the thermal energy applied to the medium M. In the embodiment, it is configured so that the position of the peak value of the thermal energy E is set to be located in the vicinity of the upstream end of the discharge area 13 in the transport direction Y. The first configuration portion 35 is provided in a shape in which the first configuration portion 35 is provided in a part of the heated area 11, as illustrated in FIG. 2.

A large amount of thermal energy is applied from the heating portion 9 to the heated area 11. Even in the structure with the view described above, the first configuration portion 35 is provided in the portion to which a large amount of thermal energy is applied, and thus thermal unevenness in relation to the liquid Q can be suppressed in the discharge area 13 and the amount of heat of the thermal energy transferred to the medium support portion 7 can be effectively reduced. Accordingly, the liquid Q discharged onto the medium M can be evenly dried and it is possible to effectively perform heating with further reduced energy.

In other words, the first configuration portion 35 may be provided in at least a part of the support surface 5 in the discharge area 13 or the heated area 11.

Furthermore, a downstream-side support portion 37 which is located further on the downstream side than the medium support portion 7 (which is the first member 32 and the second member 33, in other words, the first configuration portion 35) in the transporting direction of the medium M and can support the medium M is provided, as illustrated in FIGS. 1 to 4. The heat capacity of the downstream-side support portion 37 is greater than that of the first configuration portion 35. Here, the heat capacity is calculated by the product of the mass (which is the product of the volume and the density) and the specific heat of an object. In the embodiment, the main body portion 41 also functions as the downstream-side support portion 37. Thus, the downstream-side support portion 37 is provided in the downstream side of the first configuration portion 35 and, further, is also provided on the lower side of the first configuration portion 35.

The specific material of the downstream-side support portion 37 is not particularly limited. However, an aluminum used as a material of the main body portion 41, as described above, is preferable as a material of the downstream-side support portion 37. The support surface 5 of the downstream-side support portion 37 of the embodiment is subjected to alumite processing.

As a result, the radiation rate of the support surface 5 of the downstream-side support portion 37 is the same as that of the support surface 5 of the first member 32. In addition, it is configured so that the heat capacity of the downstream-side support portion 37 is set to be greater than that of the first configuration portion 35. Accordingly, the heat of the medium M is diffused over the downstream-side support portion 37, in such a manner that an increase in the temperature of the medium M is suppressed and the temperature of the medium M can be maintained within the intended temperature range.

The radiation rate of the support surface 5 of the first member 32 of the embodiment is set to a value equal to or greater than 0.7 and less than 1. In other words, the radiation rate of the support surface 5 of the first member 32 is matched to that of the medium M. In a case where the radiation rate of the support surface 5 is close to that of the medium M, when a certain amount of thermal energy is supplied from the heating portion 9, the temperature change of the support surface 5 is also similar to that of the medium M. Accordingly, the temperature of the support surface 5 can be appropriately maintained by setting the radiation rate of the support surface 5 to be close to that of the medium M. Furthermore, the energy emitted from a part of the heated area 11 is sensed by a sensor (for example, an infrared sensor and an ultraviolet light sensor), in such a manner that an output control of the heating portion 9 is performed. When the medium M is present in an area subjected to sensing by a sensor, the energy emitted from the medium M is detected. When the medium M is not present in an area subjected to sensing by a sensor, the energy emitted from the support surface 5 is detected. When the radiation rate of the support surface 5 is close to that of the medium M, the amount of energy emitted from the support surface 5 is also close to the amount of the energy emitted from the medium M. Accordingly, the radiation rate of the support surface 5 is set to be close to that of the medium M, in such a manner that the control of the heating portion 9 is appropriately performed, and thus the temperature of the medium M or the support surface 5 can be appropriately maintained.

FIG. 6 is an explanatory view illustrating the radiation rates of various media. When the radiation rates of general media (media A to K) used as the medium M are measured by an emissivity measuring device, the radiation rates of the media is in the range of about 0.8 to about 0.95, as illustrated in FIG. 6. Accordingly, the radiation rate of a part of the first member 32, which is the support surface 5, is set to a value equal to or greater than 0.7 and less than 1. In this case, a difference between the radiation rate of the first member 32 and the radiation rate of the medium M is set to be equal to or less than 0.1. In a case where the radiation rate difference therebetween is equal to or less than 0.1, when the radiation rate difference is converted into a temperature difference, the difference corresponds to the temperature of about 3 degrees or less. As a result, it is possible to be understood that the temperature difference is within a level in which there is no problem in terms of the temperature control. Accordingly, when the radiation rate of a part of the first member 32, which is the portion corresponding to the support surface 5, is set to a value equal to or more than 0.7 and less than 1, a heater 40 can be appropriately controlled in relation to the medium, such as an acrylic resin, a PET resin, a vinyl chloride resin, cloth, and paper, exemplified in the embodiment. In addition, when the radiation rate of the first member 32 is set to a value equal to or greater than 0.85 and less than 0.95, the radiation rate difference can be further reduced in relation to the medium, such as a PET resin, a vinyl chloride resin, cloth, and paper, exemplified in the embodiment. Thus, when the radiation rate of a part of the first member 32, which is the portion corresponding to the support surface 5, is set to a value equal to or greater than 0.85 and less than 0.95, heating of the medium can be appropriately performed. In addition, when the radiation rate of the first member 32 is set to 0.9, the radiation rate difference can be reduced in relation to a medium of a vinyl chloride resin exemplified in the embodiment. Thus, when the radiation rate of the first member 32 is set to 0.9, heating can be appropriately performed in relation to some media.

The first member 32 of the embodiment is an aluminum subjected to alumite processing. In other words, a part of the first member 32, which is the portion corresponding to the support surface 5, is subjected to alumite processing. Accordingly, the radiation rate thereof is significantly increased, by the alumite processing, from about 0.1 which is a value corresponding to the radiation rate of an aluminum to about 0.9. Thus, a difference (in other words, a radiation rate difference) between the radiation rate of the first member 32 and the radiation rate of the medium M is equal to or less than 0.1. As a result, the radiation rate of a part of the first member 32, which is the support surface 5 in relation to the medium M, is increased, and thus the temperature of the support surface 5 can be appropriately maintained. In addition, the medium M can be appropriately heated.

The heat capacity of the first member 32 is set to be smaller than that of the second member 33. Accordingly, the amount of heat transferred is small in the first member 32 because the heat capacity of the first member 32 is relatively small. Therefore, the temperature transfer speed is increased, and thus unevenness in temperature can be reduced.

A member having a thickness of 0.1 mm to 1.0 mm is used as the first member 32. A member having a thickness of 0.3 mm to 0.5 mm is more preferable as the first member 32.

Therefore, the thickness of the first member 32 is set to be relatively small, and thus the heat capacity of the first member 32 is reduced. Accordingly, the amount of heat transferred from the medium M to the first member 32 is reduced, and thus the thermal efficiency can be increased.

It is preferable that a part of the first member 32, which is the portion corresponding to the support surface 5, has a dynamic friction coefficient of 0.4 or less. Accordingly, the medium transport resistance can be reduced, and thus damage to the medium M in a heated state is reduced in a transport process. Furthermore, the medium M is prevented from being caught and stuck. When the medium M is stuck and transport of the medium M is stopped, a specific part of the medium M is excessively heated, and thus the medium M is significantly damaged. However, when the dynamic friction coefficient is set to a value equal to or less than 0.4, such a concern can be reduced.

The second member 33 is constituted of a low thermal conductivity member of which the thermal conductivity is set to a value equal to or less than 0.4 W/mK. Furthermore, the thermal conductivity of the second member 33 is less than that of the first member 32. Therefore, it is difficult for the transferred heat to be transferred to the main body portion 41 side, and thus heat retaining effect is increased. As a result, power saving can be achieved.

In the embodiment, a member having the water absorption rate of 0.2% or less is used as the second member 33. When the second member 33 absorbs moisture, the thermal conductivity of the second member 33 is changed due to the influence of the absorbed moisture. According to the configuration described above, the water absorption rate of the second member 33 is set to a value equal to or less than 0.2%, and thus the water absorption rate of the second member 33 can be within a range in which an influence of a change in thermal conductivity due to moisture absorption is small. As a result, it is possible to maintain the intended function of the second member 33, which is a function that the liquid Q discharged onto the medium M can be effectively heated with a small amount of thermal energy.

It is preferable that the heat resistance temperature of the second member 33 is set to a value equal to or greater than 150° C. Accordingly, the thermal deformation of the second member 33 can be prevented.

In addition, it is preferable that the thickness of the second member 33 is set to a value equal to or greater than 2 mm. When the second member 33 has a large thickness, the mass of the second member 33 is also increased in accordance with the large thickness thereof. Accordingly, the heat capacity of the second member 33 is increased, and thus it is difficult for the temperature thereof to be changed. Thus, the thermal insulation property of the second member 33 can be stabilized.

It is preferable that the bending strength of the second member 33 is set to a value equal to or greater than 50 MPa. Accordingly, bending deformation of the second member 33 can be prevented from occurring.

In addition, it is preferable that the compressive strength of the second member 33 is set to a value equal to or greater than 50 MPa. Accordingly, compressive deformation of the second member 33 can be prevented from occurring.

For example, a material which is obtained by laminating sheet-shaped materials containing a thermosetting resin, a balloon, and a fiber-reinforced material can be exemplified as a material of the second member 33, which satisfies the conditions described above. In this case, the balloon means fine particles which contain bubble-shaped air and are added as a filler of a binder in order to reduce the weight of a laminate plate of which the material is constituted of a thermosetting resin and a fiber-reinforced material. An organic balloon and an inorganic balloon are known. In other words, the balloon is a filler having low specific gravity.

For example, a phenolic resin, an epoxy resin, a silicone resin, a polyester resin, a melamine resin, a thermosetting polyimide resin, or the like can be used by along, as the thermosetting resin used in the embodiment. A plurality of materials described above may be mixed and used as the thermosetting resin used in the embodiment.

For example, an organic balloon made of a synthetic resin, a cellulose, or the like, and an inorganic balloon made of shirasu, glass, or alumina, each of which has the specific gravity of about 0.05 to 0.70 can be applied as the balloon.

For example, a sheet-shaped material obtained by processing an inorganic fiber, such as a glass fiber, a carbon fiber, a rock wool, and a metal fiber, a natural fiber, such as whisker, cotton, hemp, and the like, and an organic fiber made of a synthetic fiber can be applied as the fiber-reinforced material.

Specifically, a "(product name) calyte" produced by NIKKO KASEI CO., LTD, which is obtained by performing fusion-molding of the materials described above in a thermal pressing manner can be used as a preferable material of the second member 33. In addition, other BMC (a glass epoxy) or the like can be used as the material of the second member 33.

Figure 5:
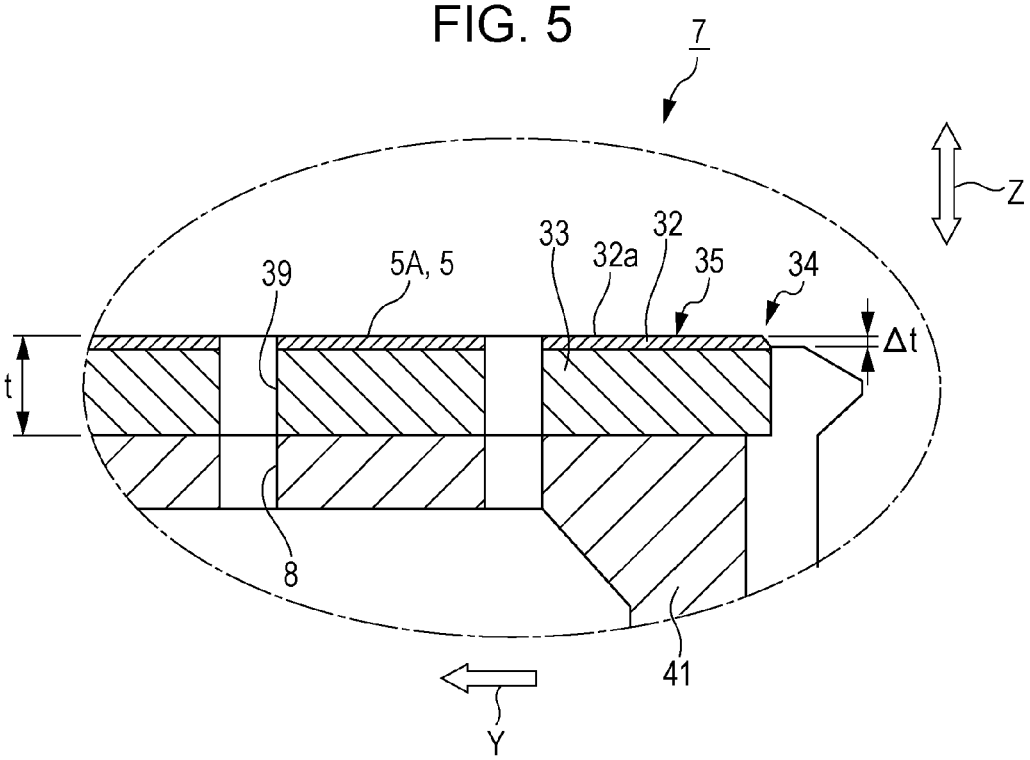
FIG. 5 is a partially enlarged lateral cross-sectional view illustrating the medium support portion of the liquid discharging apparatus according to Embodiment 1.

In the embodiment, the height of a support surface 5A formed of the first configuration portion 35 is higher, by the size Δt, than that of another support surface 5B of the medium support portion 7, as illustrated in FIG. 5. Furthermore, a stepped portion 34 on the upstream side of the first configuration portion 35 in the transport direction Y is subjected to chamfering.

Incidentally, the reason why a convex shape of size Δt is provided is that, when the medium M passes through the first configuration portion 35, the convex shape causes the medium M to reliably come into contact with a surface 32*a* (in other words, the support surface 5A) of the first member 32, and thus the convex shape makes the first member 32 to exhibit the heat diffusion effect thereof. In addition, the reason why the stepped portion 34 is subjected to chamfering is that the chamfered portion prevents the medium M from being caught by the stepped portion 34, and thus transport of the medium M is smoothly performed.

Furthermore, in the embodiment, in consideration of the maximum difference (which is about 0.2 mm) in level in the width direction X, the size Δt is set to, for example, 0.5 mm and the stepped portion 34 is subjected to chamfering of, for example, C0.5.

In the embodiment, the external dimensions of the first configuration portion 35 are set as follows. A width B is set to 60 mm, a length L is set to 600 mm, and a thickness t is set to 5 mm. In one liquid discharging apparatus 1, three first configuration portions 35 are used in a state where the first configuration portions 35 are aligned in the width direction X.

A plurality of holes 39 having the diameter of, for example, 3 mm are formed in the support surface 5A of the first configuration portion 35. It is configured so that the hole 39 communicates with a suction hole 8 formed in the main body portion 41 of the medium support portion 7, and thus a predetermined suction operation is performed in relation to the medium M. The hole centers of the hole 39 and the suction hole 8 may not be matched, or may be different from the illustration of the accompanying drawing, as long as the hole 39 and the suction hole 8 communicate with each other. In addition, the holes may not have the same diameter, or may be different from the illustration of the accompanying drawing. Furthermore, the number of the holes 39 may not be necessarily two or more.

Furthermore, in a bottom surface of the concave portion 43, the support surface 5B in a portion between two sensing groove portions 45, and the support surface 5B in an area downstream from the two sensing groove portions 45 in the transport direction Y, a plurality of suction holes 8 are provided, at appropriate intervals, over the scanning range of the carriage 23 in the width direction X.

Next, an operation and an effect of the liquid discharging apparatus 1 of the embodiment will be described with reference to FIG. 2. The medium M to which a transport force is applied by the nip rollers 27 moves from a nip point N and reaches the discharge area 13 below the discharge head 19. Then, ink as the liquid Q is discharged, in such a manner that predetermined recording is performed.

The heated area 11 is provided in a state where the heated area 11 includes the discharge area 13. The liquid Q discharged onto the medium M in the discharge area 13 is irradiated with the electromagnetic wave A emitted from the heating portion 9, and thus radiation heat is generated. As a result, the liquid Q is heated.

In this case, the first configuration portion 35 is provided below the discharge area 13 or in an area below the medium M passing through the heated area 11. The temperature of the support surface 5 is appropriately maintained because the radiation rate of a part of the first member 32, which is the portion supporting the medium M, is close to that of the medium M. Accordingly, the heating temperature in relation to the medium is appropriately maintained.

In the second member 33 below the first member 32, it is difficult for the thermal energy E which is applied, by the thermal insulation effect, to the medium M illustrated in FIG. 2 to be transferred to the inner portion of the medium support portion 7.

Therefore, the liquid Q discharged onto the medium M can be evenly heated and it is possible to effectively perform heating with a small amount of thermal energy E. In other words, the heating effect in relation to the medium M is increased.

The temperature of the medium M passing through the discharge area 13 or the heated area 11 is set to a low value so that the temperature is substantially set to a constant value of, for example, about 50° C. As a result, a temperature increase in the discharge surface of the discharge head 19 is also prevented, and thus nozzle clogging is also prevented.

When the medium M passes through the discharge area 13 or the heated area 11 and the medium M is transported further to the downstream side in the transport direction Y, a temperature increase of the medium M is prevented by the heat diffusion effect of the downstream-side support portion 37. As a result, it is possible to prevent a temperature increase of a casing body of the liquid discharging apparatus 1, a temperature increase of the carriage 23, and a temperature increase of the discharge surface of the discharge head 19.

Incidentally, in a case where the downstream-side support portion 37 is not provided, the temperature of the medium M is continuously increased. Therefore, the medium M is damaged or the temperature of the casing body of the liquid discharging apparatus 1 is increased, and thus each component of the liquid discharging apparatus 1 is damaged. As a result, there is a concern in that there may be a bed influence to the performance or the life span of the product.

In contrast, in a case of the embodiment, heat is transferred to the outside by the heat diffusion effect of the downstream-side support portion 37, and thus a temperature increase of the medium M, the casing body, or the product is prevented. As a result, the damage to the medium M, the component, or the like is reduced, and thus the reliability of the product can be increased.

In other words, the medium support portion 7 is configured to have a hybrid structure in which the first configuration portion 35 and the downstream-side support portion 37 are provided. As a result, the thermal efficiency of the heating target can be increased and thermal damage to the medium M or the liquid discharging apparatus 1 can be reduced.

Embodiment 2

Figure 7:
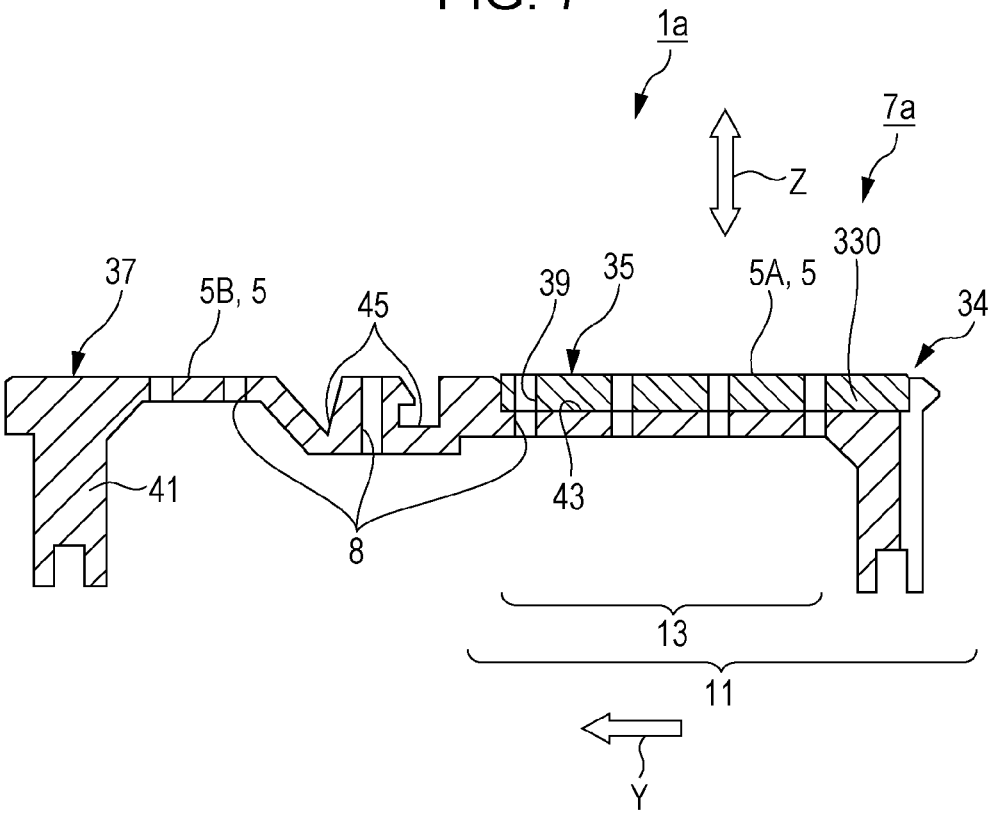
FIG. 7 is a lateral cross-sectional view illustrating a liquid discharging apparatus according to Embodiment 2.

See FIG. 7

Next, the configuration of a liquid discharging apparatus of Embodiment 2 will be described. The basic configuration of the liquid discharging apparatus of the embodiment is the same as that of Embodiment 1, and thus the description thereof is not repeated. The configuration of a portion, in other words, a medium support portion, of which the configuration is different from that of Embodiment 1 will be described. FIG. 7 is a lateral cross-sectional view illustrating the liquid discharging apparatus of the embodiment. Specifically, FIG. 7 is a lateral cross-sectional view illustrating the medium support portion of the liquid discharging apparatus of the embodiment.

A liquid discharging apparatus 1*a* of the embodiment includes the discharge portion 3 (see FIG. 1), a medium support portion 7*a*, and the heating portion 9 (see FIG. 1). The discharge portion 3 can discharge liquid. The medium support portion 7*a* has the support surface 5 which can support a medium onto which the liquid is discharged. The heating portion 9 can heat the medium M supported by the medium support portion 7*a*. At least a part of the medium support portion 7*a* is constituted of a low thermal conductivity member having the thermal conductivity of 0.4 W/mK or less. The radiation rate of the support surface 5 is set to a value equal to or greater than 0.7 and less than 1.

The medium support portion 7*a* of the embodiment is constituted of a special member 330 as a low thermal conductivity member, as illustrated in FIG. 7. The special member 330 contains a carbon. A part of the special member 330 is configured to form the support surface 5 which supports the medium M. Accordingly, properties, such as a high radiation rate and low thermal conductivity, can be obtained by a single member. Thus, for example, the man-hours for manufacturing the medium support portion 7*a* can be reduced. In addition, the radiation rate of the support surface 5 of the special member 330 is increased, and thus the temperature of the support surface 5 can be appropriately maintained. Furthermore, the temperature of the support surface 5 is appropriately maintained, and thus the supported surface of the medium M can be appropriately heated.

A material obtained by adding a carbon to the same material (which is the material obtained by laminating sheet-shaped materials containing a thermosetting resin, a balloon, and a fiber-reinforced material) as that of the second member 33 of Embodiment 1 can be exemplified as a specific material of the special member 330. A carbon is added, and thus the radiation rate of the special member 330 is increased, compared to the radiation rate of the second member 33. Accordingly, a high radiation rate can be obtained with low thermal conductivity.

Other Embodiment

The liquid discharging apparatus 1 of the invention basically has a configuration according to Embodiment 1 and Embodiment 2 described above. However, needless to say, the configuration of the invention can be partially changed or removed as long as it does not depart from the gist of the invention.

The first configuration portion 35 of the support surface 5 of the medium support portion 7 can be provided over, for example, the entirety of a range including the discharge area 13 and the heated area 11. Alternatively, the first configuration portion 35 can also be provided in, for example, a part of the range as follows. A plurality of first configuration portions 35 are provided in a state where the first configuration portions 35 are separated with appropriate gaps in the width direction X and the transport direction Y.

In addition, the values illustrating the external dimension of the first configuration portion 35, the number thereof, or the properties thereof, which are exemplified in the description of the embodiments, are examples. The values can be appropriately changed in accordance with a change in the size of the liquid discharging apparatus 1, a change in the type of the medium M, the shape of the medium support portion 7, or the like.

Supplement of Embodiment

Hereinafter, specific conditions in relation to the embodiments described above will be added.

The temperature of the medium M passing through the discharge area 13 and the heated area 11 is limited so that the value of the temperature is set to be, for example, about 50° C., as described above. Specifically, the range of about 50° C. may be a range of 35° C. to 60° C. Furthermore, it is more preferable that the range of about 50° C. is set to a range of 40° C. to 55° C. When the temperature of the medium M is set in the temperature range described above, the liquid Q discharged onto the medium M can be sufficiently dried. In other words, the liquid Q is fixed to the medium M without smearing or staining due to rubbing.

When summarizing the explanation described above, the heating portion 9 heats the liquid Q discharged onto the medium M so that the temperature thereof is within the range from 35° C. to 60° C. More specifically, the heating portion 9 heats the liquid Q discharged onto the medium M so that the temperature thereof becomes in the range of 40° C. to 55° C.

In this case, the second member 33 of the first configuration portion 35 is provided, and a small amount of energy is sufficient to heat the liquid Q discharged onto the medium M to the target temperature described above.

Accordingly, in a case of such a heating condition, it is particularly preferable that the second member 33 is used.

The heat resistance temperature of the discharge portion 3 may be set to a value of about 60° C. In the embodiment described above, when the temperature of the discharge portion 3 exceeds the heat resistance temperature, there is a concern that failure, such as clogging of nozzles of the discharge head 19 with the liquid Q, may occur. The heating target of the heating portion 9 is the liquid Q discharged onto the medium M. However, the discharge portion 3 is also heated by the heating portion 9. In other words, the temperature of the discharge portion 3 is similar to the temperature of the liquid Q discharged onto the medium M. Accordingly, the heating portion 9 heats the liquid Q discharged onto the medium M so that the temperature of the liquid Q becomes equal to or lower than the heat resistance temperature of the discharge portion 3. Therefore, the liquid Q can be heated without causing failure of the discharge portion 3. The heat resistance temperature is different in accordance with the configuration of the discharge portion 3, and thus the value of the heat resistance temperature is not limited to 60° C.

In this case, the second member 33 of the first configuration portion 35 is provided in the medium support portion 7, and a small amount of energy is enough to heat the liquid Q discharged onto the medium M. Accordingly, unnecessary heating in relation to the discharge portion 3 is prevented, and thus it is more difficult for failure of the discharge portion 3 to occur.

It is particularly preferable that the heating portion 9 performs heating so that the liquid Q discharged onto the medium M can be sufficiently dried and failure of the discharge portion 3 does not occur.

In the embodiment described above, the heating portion 9 uses an infrared light beam, as described above. In this case, specifically, an infrared light beam having the maximum wavelength in the band of 2.0 μm to 6.0 μm is used. The wavelength in the band of 2.0 μm to 6.0 μm has a great heating effect in relation to molecules of water. The liquid Q of the embodiment includes moisture. Accordingly, when an infrared light beam having the maximum wavelength in the band of 2.0 μm to 6.0 μm is used, the liquid Q can be effectively heated. Furthermore, the infrared light beam used for heating may include a wavelength in another band. In addition, it is preferable that the maximum wave length of an infrared light beam is changed in accordance with the solvent of the liquid Q.

When summarizing the explanation described above, the heating portion 9 heats the liquid Q discharged onto the medium M by emitting the electromagnetic wave A having the wavelength of, at least, 2.0 μm to 6.0 μm.

In this case, the second member 33 of the first configuration portion 35 is provided in the medium support portion 7, and a small amount of energy is enough to heat the liquid Q discharged onto the medium M. Accordingly, in a case of such a heating condition, when the second member 33 is used, the liquid Q containing moisture can be more effectively heated.

The liquid Q discharged onto the medium M is dried by the blower 29 which blows the wind W towards the liquid Q discharged onto the medium M, as described above. In this case, the blower 29 blows the wind W having a wind speed of 1.0 to 4.0 (m/sec), towards the liquid Q discharged onto the medium M. When the wind speed of the wind W is excessively high, for example, flight deflection of the liquid Q discharged from the discharge portion 3 occurs.

In contrast, when the wind speed of the wind W is excessively low, the drying effect in relation to the liquid Q is reduced. Accordingly, the blower blows the wind W having the wind speed of 1.0 to 4.0 (m/sec), in such a manner that the liquid Q can be dried in a state where flight deflection of the liquid Q discharged from the discharge portion 3 is prevented.

The first configuration portion 35 is provided in the medium support portion 7 and, further, the blower 29 is provided. Thus, the liquid Q can be more effectively fixed to the medium M, compared to in a case where only the heating portion 9 is provided.

The entire disclosure of Japanese Patent Application No. 2014-135647, filed Jul. 1, 2014 is expressly incorporated reference herein.

What is claimed is:

1. A liquid discharging apparatus comprising:

a discharge portion which can discharge liquid;

a medium support portion which has a support surface which can support a medium onto which the liquid is discharged; and a heating portion which can heat the medium supported by the medium support portion, wherein the radiation rate of the support surface is set to a value equal to or greater than 0.7 and less than 1, wherein the medium support portion includes a first member which is constituted by a material different from that of a low thermal conductivity member and forms the support surface, and a second member which is the low thermal conductivity member, wherein the second member is directly beneath the first member, wherein the first member is thinner than the second member, and wherein the low conductivity member has a conductivity of 0.4 W/mK or less.

2. The liquid discharging apparatus according to claim 1, wherein the first member is constituted of aluminum subjected to alumite processing.

3. The liquid discharging apparatus according to claim 1, wherein a heat capacity of the first member is smaller than that of the second member.

4. The liquid discharging apparatus according to claim 1, wherein a thickness of the first member is set to a value equal to or greater than 0.1 mm and equal to or lower than 1.0 mm.

5. The liquid discharging apparatus according to claim 1, wherein the thermal conductivity of the second member is lower than that of the first member.

6. The liquid discharging apparatus according to claim 1, wherein a thickness of the second member is set to a value equal to or greater than 2 mm.

7. The liquid discharging apparatus according to claim 1, wherein the second member is formed by laminating sheet-shaped materials including a thermosetting resin, a balloon, and a fiber-reinforced material.

8. The liquid discharging apparatus according to claim 1, wherein, in the medium support portion, the low thermal conductivity member contains a carbon.

9. The liquid discharging apparatus according to claim 1, further comprising:

a downstream-side support portion which can support the medium in an area downstream from the medium support portion in a transport direction of the medium, wherein a heat capacity of the downstream-side support portion is greater than that of the medium support portion.

10. The liquid discharging apparatus according to claim 1, wherein a dynamic friction coefficient of the support surface is set to a value equal to or less than 0.4.

11. The liquid discharging apparatus according to claim 1, wherein, in the support surface, a suction hole is provided to allow a suction force to act on the medium.

12. The liquid discharging apparatus according to claim 1, wherein the heating portion heats the liquid discharged onto the medium so that a temperature of the liquid becomes in a range of 35° C. to 60° C.

13. The liquid discharging apparatus according to claim 1, wherein the heating portion heats the liquid discharged onto the medium so that a temperature of the liquid becomes equal to or lower than a heat resistance temperature of the discharge portion.

14. The liquid discharging apparatus according to claim 1, wherein the heating portion heats the liquid discharged onto the medium by emitting an electromagnetic wave having a wavelength of, at least, 2.0 μm to 6.0 μm.

15. The liquid discharging apparatus according to claim 1, further comprising:

a blower which blows wind to the liquid discharged onto the medium.

* * * * *